United States Patent [19]

Perilstein

[11] Patent Number: 4,521,219

[45] Date of Patent: Jun. 4, 1985

[54] ALCOHOL BASED FUELS CONTAINING CORROSION INHIBITORS

[75] Inventor: Warren L. Perilstein, Orchard Lake, Mich.

[73] Assignee: Ethyl Corporation, Richmond, Va.

[21] Appl. No.: 317,569

[22] Filed: Nov. 2, 1981

[51] Int. Cl.[3] ..... C10L 1/08

[52] U.S. Cl. ..... 44/55; 44/62; 44/66; 44/70; 252/396

[58] Field of Search ..... 44/55, 70, 62, 66; 252/396

[56] References Cited

U.S. PATENT DOCUMENTS 2,334,158 11/1943 von Fuchs et al. ..... 252/396

4,305,730 12/1981 Davis et al. ..... 252/396

*Primary Examiner*—Y. Harris-Smith

*Attorney, Agent, or Firm*—Donald L. Johnson; John F. Sieberth; W. G. Montgomery

[57] ABSTRACT

Liquid fuels having anticorrosion properties for use in internal combustion engines comprising (1) a major fraction of a monohydroxy alkanol having from 1 to about 5 carbon atoms, and (2) a corrosion inhibiting amount of a mixture of (a) from about 5 to 95 parts of at least one polymerized unsaturated aliphatic monocarboxylic acid having from about 16 to 18 carbon atoms per molecule, and (b) from about 95 to 5 parts of an aliphatic dicarboxylic acid having from 2 to about 10 carbon atoms.

32 Claims, No Drawings

ALCOHOL BASED FUELS CONTAINING CORROSION INHIBITORS

BACKGROUND

1. Field of the Invention

This invention relates to novel fuel compositions for use in internal combustion engines, especially spark ignited internal combustion engines and diesel engines. More particularly, this invention relates to alcohol-based fuels such as ethanol having rust inhibiting and/or preventing properties. The invention also is concerned with a process for conferring anticorrosion properties to alcohol-based fuels.

2. Description of the Prior Art

Alcohols seem to be promising alternatives to the petroleum-based fuels in general use today. For example, it has recently been reported in Brazilian Patent Application No. P17700392 that alcohols, such as methanol and ethanol, can be substituted for conventional petroleum derived diesel fuels for burning in diesel engines, when used in combustion with an ignition accelerator, such as ethyl nitrate or nitrite. Reportedly, the addition of alkyl nitrate or nitrite to the alcohol achieves a leval of auto-ignition sufficient to permit the operation of diesel engines on alcohol.

Methanol and ethanol are good alternatives to petroleum-based fuels. Ethanol is an especially good alternative in countries with intense cultivation of sugar cane, mandioca, and other raw materials of vegetable origin, adequate for the production of ethanol, such as Brazil.

Both methanol and ethanol, as well as other lower aliphatic alcohols such as propanol, butanol, and amyl alcohol, are good alternatives for petroleum-based fuels for the following reasons.

(1) They can be stored, transported and distributed using traditional systems in the traditional manner;

(2) With few changes, present-day engines and their accessories can be adapted to the requirements of alcohol fuels; and (3) As these fuels can be handled in existing system with limited modifications, the total investment necessitated by an eventual changeover is minimized.

The use of a polar oxygenate such as ethanol as a fuel for internal combustion engines, however, has certain disadvantages. One of these is the creation of corrosion problems both in the logistic chain and in the vehicle itself. In pipelines and storage tanks, rust, which normally would remain on the walls, is loosened by the alcohol and transported through the system. Also, as is commonly known, ethanol has a tendency to pick up water from the environment. That is, it is hygroscopic. When exposed to ethanol containing water, many of the metals and alloys which make up the vehicle fuel distribution system and the vehicle engine can corrode. Specifically, fuel tank terneplate, zinc and aluminum diecast carburetor and fuel pump parts, brass fittings, steel lines, etc., can corrode when exposed to ethanol-based fuel mixtures. This problem can be remedied to some extent by the use of anhydrous or substantially anhydrous ethanol. However, if the fuel mixture is stored for too long a period of time before use, the anhydrous ethanol will pick up water from the environment and become hydrous or ("wet") ethanol. Corrosion can also be brought about by the presence of trace amounts of acetic acid, acetaldehyde, acetate and n-butanol in the ethanol which are formed during production of the ethanol via fermentation, and the presence of dissolved mineral salts, such as highly corrosive sodium chloride, which may be picked up by the fuel during production, storage, and transportation.

Thus, there is presently a need for a corrosion inhibitor that will either curb or prevent the corrosion of conventional systems which are used to store and transport commercial ethanol fuel blends and one that will curb or prevent corrosion of the vehicle fuel systems in which these fuels are ultimately used. Further, it is important that the corrosion inhibitor be effective in very small quantities to avoid any adverse effects, such as adding to the gum component of the fuel, etc., as well as to minimize cost. The corrosion inhibitors of the present invention satisfy these needs.

U.S. Pat. No. 2,334,158 discloses an anti-corrosive composition of matter comprising predominately non-gaseous hydrocarbons containing small amounts each of a polycarboxylic acid having at least 16 carbon atoms and a mutual solvent for hydrocarbons and water such as di-ethylene glycol mono alkyl ether or an ethylene glycol mono alkyl ether.

U.S. Pat. No. 2,631,979 discloses a mineral lubricating oil containing dissolved therein 0.1% to 2% of a polymerized linoleic acid which consists essentially of the dimer.

U.S. Pat. No. 2,632,695 discloses a normally liquid, non-lubricating mineral oil fraction containing a minor proportion, sufficient to prevent rusting of ferrous metal surfaces in contact therewith, of an antirust agent selected from the group consisting of (1) dimeric acids produced by the condensation of unsaturated, aliphatic monocarboxylic acids having between about 16 and 18 carbon atoms per molecule, (2) dimeric acids produced by the condensation of hydroxyaliphatic monocarboxylic acids having between about 16 and about 18 carbon atoms per molecule, (3) trimeric acids produced by the condensation of unsaturated, aliphatic monocarboxylic acids having between about 16 to about 18 carbon atoms per molecule, (4) trimeric acids produced by the condensation of hydroxyaliphatic monocarboxylic acids having between about 16 and about 18 carbon atoms per molecule.

U.S. Pat. No. 2,962,443 discloses steam turbine lubricants containing the reaction product of:

(a) an aliphatic hydrocarbon-substituted succinic acid having the structure

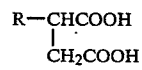

in which R is an aliphatic hydrocarbon radical having at least 10 carbon atoms, with (b) from about 1 to about 75 percent on a molar basis of an alkylene oxide.

Reportedly, the addition of such a product to a steam turbine lubricant comprising a major amount of a mineral oil renders the lubricant resistant to rust and to the formation of stable emulsions.

U.S. Pat. No. 2,993,772 discloses a process for preventing, inhibiting, and modifying the formation of deposits in internal combustion and jet engines employing a substantially hydrocarbon fuel which comprises burning in such engines a fuel consisting of a liquid hydrocarbon having a boiling point up to about 500° F. and a minor amount, in the range of approximately 0.001 to 2% by weight of the fuel, sufficient to prevent, inhibit, and modify such deposits, of a member selected from the group consisting of an oil soluble alkenyl succinic acid and the anhydride thereof, having 8 to 31 carbon atoms on the alkenyl group.

U.S. Pat. No. 2,993,773 discloses a process for preventing, inhibiting, and modifying the formation of deposits in internal combustion and jet engines employing a substantially hydrocarbon fuel which comprises burning in such engines a fuel consisting of a liquid hydrocarbon having a boiling point up to about 500° F. and a minor amount, in the range of approximately 0.001 to 2.0 weight percent of said fuel sufficient to prevent, inhibit, and modify such deposits, of an ester of (1) a member selected from the group consisting of an alkenyl succinic acid and the anhydride thereof, having 8 to 31 carbon atoms on the alkenyl group and (2) an alcohol, said ester being soluble in said liquid hydrocarbon and being composed of only carbon, hydrogen, and oxygen.

U.S. Pat. No. 3,117,091 discloses as rust preventative compounds for a petroleum-based carrier such as motor gasoline, aviation gasoline, jet fuel, turbine oils and the like, the partial esters of an alkyl or alkenyl succinic anhydride produced by the reaction of one molar equivalent of a polyhydric alcohol with two molar equivalents of the anhydride.

U.S. Pat. No. 3,234,131 relates to lubricants, particularly lubricants comprising lubricating oil, metal salt as a thickener, and a small amount of an alkenyl succinic acid or anhydride, wherein the alkenyl group is preferably a high molecular weight group.

U.S. Pat. No. 3,287,268 discloses the addition to sulfurized and/or chlorinated cutting oils an alkenyl succinic acid ester derivative to reduce the tendency of the oil to produce foam and to lessen the stability of the foam that is produced. The alkenyl succinic acid ester derivative employed comprises a mixture of an alkenyl succinic acid and an ester formed from that acid, or from a related alkenyl succinic acid containing about 8 to 30 carbon atoms in the alkenyl group, and a glycol of 2 to 4 carbon atoms.

U.S. Pat. No. 3,288,714 discloses a composition comprising a lubricating oil and from about 0.05% to about 25% by weight of alkenyl succinic anhydrides wherein the alkenyl group has a molecular weight of from about 900 to about 2000 and is a polymer of a lower alkene.

U.S. Pat. No. 3,346,354 discloses a hydrocarbon fuel composition capable of reducing intake valve and port deposits which comprises a major proportion of a distillate hydrocarbon mixture boiling substantially in the range of from 100° F. to 750° F. and from 50 to 1000 ppm of a succinic acid derivative selected from the group consisting of (A) an alkenyl succinic acid,
(B) an alkenyl succinic anhydride, and
(C) an alkenyl succinic ester in which the alkoxy group contains from 1 to 6 carbon atoms, wherein the alkenyl groups (A), (B), and (C) contain from 50 to 250 carbon atoms.

U.S. Pat. No. 3,381,022 discloses ester derivatives of a hydrocarbon-substituted succinic acid wherein the hydrocarbon substituent contains at least about 50 aliphatic carbon atoms, the substituent being further characterized by having no more than about 5% olefinic linkages therein based on the total number of carbon-to-carbon covalent linkages in the substituent. The esters include the acidic esters, diesters, and metal salt esters wherein the ester moiety is derived from monohydric and polyhydric alcohols, phenols, and naphthols. These esters are useful as additives in lubricating compositions, fuels, hydrocarbon oils, and power transmitting fluids as well as being plasticizers, detergents, anti-rust agents, and emulsifiers.

U.S. Pat. No. 3,574,574 discloses a motor fuel composition which promotes reduced intake valve and port deposits containing from 0.005 to 0.1 volume percent of a polyester of a polymerized carboxylic acid.

U.S. Pat. No. 3,632,510 discloses lubricating and fuel compositions comprising a major amount of a lubricating oil and a minor proportion of an ester derivative of a hydrocarbon-substituted succinic acid wherein the hydrocarbon substituent contains at least about fifty aliphatic carbon atoms, the substituent being further characterized by having no more than about 5% olefinic linkages therein based on the total number of carbon-to-carbon covalent linkages in the substituent. The esters include the acidic esters, diesters, mixed ester-metal salts, and mixtures of these wherein the ester moiety is derived from monohydric and polyhydric alcohols, phenols, naphthols, and the like.

U.S. Pat. No. 3,687,644 discloses a gasoline composition containing as anti-icing additives 0.00001% to 0.02% by weight of a mono- or polycarboxylic acid, or an anhydride, ester, amide, imide thereof; and 0.01% to 5% by weight of an alcohol, glycol, or polyol. Optionally, an ester of an alkoxylated phenol-aldehyde resin is also present.

U.S. Pat. No. 3,925,030 discloses an anti-icing composition, useful as a gasoline additive, comprising 30–90 weight percent of a gasoline soluble organic compound of the formula Z—OH and 10–70 weight percent of a gasoline soluble polycarboxy hydrocarbon having 25–75 carbon atoms and at least ten carbon atoms per carboxy group, Z containing about 4–180 carbon atoms and being selected from aliphatic hydrocarbyl, hydroxy aliphatic hydrocarbyl, hydropoly(oxyalkylene), alkyl poly(oxyalkylene) and alkylphenyl poly(oxyalkylene), for example, an anti-icing composition comprising 30–90 weight percent of linoleic acid dimer trimer acid and 10–70 weight percent of dipropylene glycol.

U.S. Pat. No. 4,002,437 discloses a diesel fuel composition comprising a mixture of hydrocarbons boiling in a range from about 310° to 475° F. containing an additive mixture composed of (1) dimeric and trimeric acids produced by the condensation of unsaturated aliphatic monocarboxylic acids having between about 16 and about 18 carbon atoms per molecule, and hydroxyaliphatic monocarboxylic acids having between about 16 to about 18 carbon atoms per molecule, (2) a normally liquid completely or partially neutral amine salt of an oxo-alkyl acid ester of orthophosphoric acid in which each esterifying oxo-alkyl group contains 13 to 16 carbon atoms and the amine is an aliphatic hydrocarbon monoamine of 16 to 24 carbon atoms in which each aliphatic hydrocarbon radical is attached to the nitrogen through a saturated carbon atom, (3) an aliphatic demulsifier consisting of fatty acids alkoxylated by a mixture of ethylene and propylene oxides and (4) a saturated hydrocarbon solvent.

U.S. Pat. No. 4,128,403 discloses a fuel additive having improved rust-inhibiting properties comprising (1) from 5 to 50 weight percent of a hydrocarbyl amine containing at least 1 hydrocarbyl group having a molecular weight between about 300 and 5000, (2) from 0.1 to 10 weight percent of a $C_{12}$ to $C_{30}$ hydrocarbyl succinic acid or anhydride, (3) from 0.1 to 10 weight percent of a demulsifier, and (4) 40 to 90 weight percent of an inert hydrocarbon solvent. A gasoline composition is also disclosed containing from 50 to 400 ppm of the above-identified fuel additive.

U.S. Pat. No. 4,141,693 disclose gasoline containing an added manganese compound to improve the octane rating of the gasoline and including a small amount of an additive selected from a group consisting of a monocarboxylic acid or its ester, a dicarboxylic acid or its monoester or diester, an alkylamine, a substituted phenol or mixture thereof.

U.S. Pat. No. 4,148,605 discloses novel dicarboxylic ester-acids resulting from the condensation of an alkenyl-succinic anhydride with an aliphatic hydroxy acid having from 2 to about 18 carbon atoms and amine salts of said ester-acid as rust or corrosion inhibitors in organic compositions.

U.S. Pat. No. 4,175,927 discloses exhaust hydrocarbon emissions of an internal combustion engine being operated on gasoline containing a cyclopentadienyl manganese anti-knock are reduced by the addition of a dimer or a trimer acid or mixture of a dimer and a trimer acid produced by the polymerization or condensation of an unsaturated aliphatic monocarboxylic acid having between 16 and 18 carbon atoms per molecule to the gasoline.

U.S. Pat. No. 4,177,768 discloses an anti-wear compression ignition fuel for use in diesel engines comprising (1) a monohydroxy alkanol having from 1 to 5 carbon atoms, (2) an ignition accelerator, and (3) a wear inhibiting amount of a dimerized unsaturated fatty acid and an ester of a phosphorus acid.

U.S. Pat. No. 4,185,594 discloses an anti-wear compression ignition fuel for use in diesel engines comprising (1) a monohydroxy alkanol having from 1 to 5 carbon atoms, (2) an ignition accelerator, and (3) a wear inhibiting amount of a dimerized unsaturated fatty acid.

U.S. Pat. No. 4,207,076 discloses crude ethyl-t-butyl ether used as a cosolvent for hydrous ethanol in gasoline fuel mixtures. The ether solubilizes grain alcohol in all proportions in low aromatic content gasolines.

U.S. Pat. No. 4,207,077 discloses pure methyl-t-butyl ether used as a cosolvent for hydrous ethanol in gasoline fuel mixtures. The ether solubilizes grain alcohol in all proportions in low aromatic content gasolines.

U.S. Pat. No. 4,214,876 discloses improved corrosion inhibitor compositions for hydrocarbon fuels consisting of mixtures of (a) about 75 to 95 weight percent of a polymerized unsaturated aliphatic monocarboxylic acid having about 16 to 18 carbons, and (b) about 5 to 25 weight percent of a monoalkenyl-succinic acid wherein the alkenyl group has 8 to 18 carbons. Also described are concentrates of the above compositions in hydrocarbon solvents, as well as fuels containing the compositions.

U.S. Pat. No. 4,227,889 discloses an anti-wear compression ignition fuel composition for use in diesel engines comprising (1) from about 70 percent by weight to about 98.45 percent by weight of a monohydroxy alkanol having from 1–5 carbon atoms, (2) from about 1 percent by weight to about 25 percent by weight of a fuel oil boiling above the gasoline boiling range, and (3) a wear inhibiting amount of a dimerized unsaturated fatty acid. Optionally, said fuel composition may also contain an ignition accelerator such as an organic nitrate.

U.S. Pat. No. 4,242,099 discloses an anti-wear compression ignition fuel for use in diesel engines comprising (1) a monohydroxy alkanol having from 1 to 5 carbon atoms, and (2) a wear inhibiting amount of a $C_{12}$ to $C_{30}$ hydrocarbyl succinic acid or anhydride, e.g., tetrapropenyl succinic acid. Optionally, said fuel composition may also contain an ignition accelerator such as an organic nitrate.

U.S. Pat. No. 4,248,182 discloses an anti-wear compression ignition fuel for use in diesel engines comprising (1) a monohydroxy alkanol having from 1 to 5 carbon atoms, and (2) a wear inhibiting amount of a $C_8$ to $C_{20}$ aliphatic monocarboxylic acid. Optionally, said fuel composition may also contain an ignition accelerator such as an organic nitrate.

SUMMARY OF THE INVENTION

This invention is a fuel comprising a major amount of a monohydroxy alkanol having from 1 to about 5 carbon atoms, and a mixture of (a) from about 5 to 95 parts of at least one polymerized unsaturated aliphatic monocarboxylic acid having from about 16 to 18 carbon atoms per molecule, and (b) from about 95 to 5 parts of an aliphatic dicarboxylic acid having from 2 to about 10 carbon atoms.

In accordance with the present invention, from about 1.0 to 100 ppm of the corrosion inhibiting compositions of the present invention are blended with a fuel consisting predominately of a monohydroxy alkanol having from 1 to about 5 carbon atoms.

Processwise, the invention resides in blending, using suitable mixing equipment, a monohydroxy alkanol having from 1 to about 5 carbon atoms, and the corrosion inhibiting compositions of the present invention in the above given proportions.

As shown below, the addition of a mixture of the aforedescribed corrosion inhibiting component additives of the present invention to an alcohol-based fuel imparts anti-corrosion properties to the fuel.

DESCRIPTION OF THE PREFERRED EMBODIMENTS

Thus, a preferred embodiment of the present invention is a liquid fuel for use in internal combustion engines comprising a major amount of a monohydroxy alkanol having from 1 to about 5 carbon atoms, and a corrosion inhibiting amount of a mixture of (a) from about 5 to 95 parts of at least one polymerized unsaturated aliphatic monocarboxylic acid having from about 16 to 18 carbon atoms per molecule, and (b) from about 95 to 5 parts of an aliphatic dicarboxylic acid having from 2 to 10 carbon atoms.

Another embodiment of the present invention is a process for conferring anti-corrosion properties to an alcohol-based fuel which comprises adding to a fuel comprising a major amount of a monohydroxy alkanol having from 1 to about 5 carbon atoms a corrosion inhibiting amount of a mixture of (a) from about 5 to 95 parts of at least one polymerized unsaturated aliphatic monocarboxylic acid having from about 16 to 18 carbon atoms per molecule, and (b) from about 95 to 5 parts of an aliphatic dicarboxylic acid having from 2 to about 10 carbon atoms.

Component (a)

The polymerized unsaturated aliphatic monocarboxylic acids contemplated to be employed herein are those prepared from the corresponding monocarboxylic acids by methods which are well known in the art. As will be appreciated by those skilled in the art, such polymerized acids generally contain 75% or more of dimer, trimer, and higher polymerized acids and 25% or less of unpolymerized monocarboxylic acid.

For convenience, the "polymerized unsaturated aliphatic monocarboxylic acid having about 16 to 18 carbon" may be referred to as "Component (a)". It will be understood that the expression, "Component (a)", encompasses a mixture of monocarboxylic acid, dimer, trimer, and higher polymerized acids as explained more fully heretofore and hereafter.

The products prepared by polymerization of unsaturated aliphatic monocarboxylic acids are sometimes referred to as "dimer acids" or "trimer acids" in the art. Such expressions are derived from the character of the major component of the polymerized product, i.e., dimer acids or trimer acids. The so-called dimer and trimer acids of the art are encompassed by the expression "Component (a)" employed herein. The term "dimer acid" may be employed hereafter to refer to "Component (a)" acid in which the dimer acid is the major constituent.

Descriptions of the preparation and properties of dimer and trimer acids can be found in the Journal of the American Oil Chemists' Society 24, 65 to 68 (1947); and in U.S. Pat. Nos. 2,482,761, 2,631,979, 2,632,695, and 2,794,782. As shown in the art, dimer acids can be prepared by heating under pressure an unsaturated fatty acid in the presence of a small amount of water at a temperature of 260° to 360° C. for 3 to 8 hours. The dimer acid thus produced usually also contains some unpolymerized monocarboxylic acid, some trimer acid and some higher polymerized acids. If desired, the amount of the trimer acids can be increased by varying the reaction conditions.

Commercially available dimer acids include "Empol" Dimer Acids (Emery Industries). They are prepared by polymerizing linoleic acids, and contain from 40% to 95% of dimer acids and from 4% to 25% of trimer acids. Commercial trimer acids include "Empol" Trimer Acids which contain from 40% to 95% of trimer acids and from 5% to 25% of dimer acids. Both types of compositions can contain up to 25% of monocarboxylic acids.

Because of their availability and low cost, mixtures of fatty acids called "tall oil fatty acids" are often used to produce dimer and trimer acid compositions. Polymerized tall oil fatty acids, such as "Century ®D-75" (Union Comp Corporation, Chemical Division, P.O. Box 6170, Jacksonville, Fla. 32205) can be used to prepare the compositions of this invention. A typical analysis of "Century ®D-75" (in weight percentages) is as follows:

| | |
|---|---|
| Acid Value | 148 |
| Unsaponifiables, % | 2 |
| Viscosity, SSU, 97° C. (210° F.) | 350 |
| Moisture, % | 0.1 |
| Iodine Value | 55 |
| Saponfication Value | 173 |
| Monomers, % | 11 |
| Dimer, % | 45 |
| Trimer or greater, % | 44 |

Component (b)

The contemplated aliphatic dicarboxylic acids are well known in the art and are the aliphatic dicarboxylic acids having from 2 to about 10 carbon atoms. Included are oxalic, malonic, succinic, glutaric, adipic, pimelic, sebacic, suberic, azelaic, maleic, and fumaric acids. It is understood that mixtures of these acids may be employed in the practice of the present invention. Preferred acids are oxalic, sebacic, and azelaic acids. The acids are all solids. The lower members are appreciably soluble in water, and only slightly soluble in organic solvents; border-line solubility in water is found at $C_6$-$C_7$. Methods by which these dicarboxylic acids are made are well known to those skilled in the art. Most are simply adaptations of methods used for preparing monocarboxylic acids. For example, where hydrolysis of a nitrite yields a monocarboxylic acid, hydrolysis of a dinitrite yields a dicarboxylic acid. Some of the methods are special ones applicable only to single acids such as oxalic or succinic acids. Oxalic acid, for example, can be prepared by heating sodium formate in the presence of sodium hydroxide to form sodium oxalate and subsequently acidifying the sodium oxalate with sulfuric acid to form oxalic acid. Succinic acid, for example, can be prepared by heating benzene in the presence of oxygen and vandium pentoxide to form maleic anhydride followed by the subsequent reduction of maleic acid to form succinic acid. All of the aforedescribed dicarboxylic acids are available commercially. The demonstrated effectiveness of the aliphatic dicarboxylic acids in the rust preventative or retardant compositions of the present invention would appear to indicate that perhaps aromatic dicarboxylic acids, such as phthalic acids, may also function as effective corrosion inhibitors in alcohol-based fuel mixtures.

As set forth above, the corrosion inhibiting compositions of the present invention may contain from about 5 to 95 parts of component (a) and from about 95 to 5 parts of component (b). Especially preferred compositions contain approximately equal parts of component (a) and component (b).

Monohydroxy alcohols which can be used in the present invention include those containing from 1 to about 5 carbon atoms. Preferred alcohols are saturated aliphatic monohydric alcohols having from 1 to about 5 carbon atoms. Methanol, ethanol, propanol, n-butanol isobutanol, t-butyl alcohol, amyl alcohol, and isoamyl alcohol are preferred for use in the present invention. Of these, ethanol is the most preferred.

Other additives may be used in formulating the fuel compositions of the present invention. These compounds may include demulsifying agents, antioxidants, dyes, process oil, benzene, ignition accelerators, and the like provided they do not adversely effect the anti-corrosive effect of the corrosion-inhibiting additives of the invention.

Conventional blending equipment and techniques may be used in preparing the fuel compositions of the present invention. In general, a homogeneous blend of the foregoing active components is achieved merely by blending components (a) and (b), either separately or combined, with the monohydroxy alkanol and any of the other desired abovedescribed components in a determined proportion sufficient to reduce the corrosion-causing tendencies of the fuels. This is usually carried out at ambient temperature.

The preferred ethanol blending component of the present fuel mixtures can be either anhydrous or hydrous ethanol. That is, either 200 proof ethanol or hydrous (or "wet") ethanol containing up to about 25 volume percent water can be blended with the anti-corrosion components of the fuel mixtures of this invention. Normally, 190 proof ethanol (95% ethanol+5% water) is used as the alcohol component of the fuel. The amount of ethanol which can be present in the fuel mixtures of the present invention can be essentially 100% by volume when anhydrous ethanol is used, but can range as low as about 75 percent by volume ethanol with the balance of the fuel component being comprised of water.

While the foregoing disclosure has thus far illustrated the invention mainly by reference to the use of ethanol as the alcohol blending agent or component of the fuel mixture, it is to be understood that ethanol can be replaced in the present fuel mixtures with other suitable alcohol blending agents such as methanol, propanol, n-butanol, isobutanol, t-butyl, and amyl alcohols as previously disclosed in approximately the same amounts by volume as ethanol.

As set forth above, from about 1.0 to about 100 ppm, and preferably from about 5 to 50 ppm, of the corrosion inhibiting component compositions of the present invention are blended with the alcohol component of the fuel.

The corrosion inhibiting compounds of the present invention also can be conveniently utilized as concentrates, that is, as concentrated solutions in suitable solvents. When used as a concentrate the additive composition will contain about 35% to 85%, by weight, of a mixture of corrosion inhibiting components (a) and (b) in the amounts set forth hereinabove and about 65% to 15%, by weight, of a solvent. A preferred concentrate will have about 60% to 80%, by weight, of the corrosion inhibiting compositions of the present invention and about 20% to 40%, by weight, of solvent. A most preferred concentrate will have about 65% to 75%, by weight, of corrosion inhibiting composition and about 25% to 35%, by weight, of solvent. Suitable solvents can be normally liquid organic compounds boiling in the hydrocarbon fuel boiling range and may include hexane, cyclohexane, heptane, octane, isooctane, benzene, toluene, xylene, aromatic naphtha gasolines, mineral oil, and the like. Mixtures of solvents also can be used. Preferred solvents are mineral oil, xylene, and aromatic nuptha.

Thus, another embodiment of the present invention is a corrosion inhibitor concentrate comprising from about 35% to about 85%, by weight, of a mixture of (a) from about 5 to 95 parts of at least one polymerized monocarboxylic acid having from about 16 to 18 carbon atoms per molecule (b) from about 95 to 5 parts of an aliphatic dicarboxylic acid having from 2 to about 10 carbon atoms and from about 65% to about 15%, by weight, of at least one normally liquid hydrocarbon solvent.

Obviously, many modifications and variations of the invention hereinbefore set forth may be made without departing from the spirit and scope thereof and therefore only such limitations should be imposed thereon as are indicated in the appended claims.

The following examples illustrate the invention.

EXAMPLE I

Anti-Corrosion Evaluation Tests

Various fuel blends were compared for anti-rust performance using a rust inhibiting representative composition of those disclosed hereinabove. Test fuels were prepared using a Brazilian type of alcohol fuel simulated from anhydrous ethanol contaminated with 10 volume percent water, 10 ppm $Cl^-$ as NaCl, 100 ppm acetic acid and the anti-corrosion compositions of the invention. The anhydrous ethanol, Union Carbide designated Synasol Solvent, was obtained commercially from the Union Carbide Co. It was prepared from 100 gallons of anhydrous Specially Denatured No. 1 ethanol (100 gallons of ethanol denatured with 5 gallons of methanol) denatured with 1 gallon of methyl isobutyl ketone, 1 gallon ethyl acetate, (87%–89%), and 1 gallon aviation gasoline. Comparisons were made between ethanol fuels containing no corrosion inhibitor and ethanol fuels containing a corrosion inhibiting composition representative of those disclosed herein comprising approximately equal parts in PTB (lb/1000 bbl) of a polymerized monocarboxylic acid designated "Union Camp Century ®D-75," obtained commercially from the Union Camp Corporation, Chemical Division, P.O. Box 6170, Jacksonville, Fla. 32205 described more fully above combined with sebacic acid obtained commercially from the Aldrich Chemical Co., 940 West St. Paul Avenue, Milwaukee, Wis. 53233.

The test fuels were prepared by blending several samples of contaminated hydrous ethanol with approximately equal parts of the aforementioned monocarboxylic and sebacic acid anti-corrosion compounds. After the test fuels were blended, they were added to individual 8.0 oz. glass screw-capped bottles in 100 ml. amounts. Samples of control fuels were prepared using the contaminated hydrous ethanol to which no corrosion inhibiting additives were added. The control fuels also were placed in individual 8.0 oz. glass screw-capped bottles in 100 m. amounts.

Weighed metal coupons (approximately $\frac{3}{4}''\times 4''\times 1/32''$-$\frac{1}{8}''$) representative of those metals common to vehicle distribution systems and vehicle engines were inserted into the glass bottles containing the test fuels. The following metals, identified by Unified Designation No., as reported in the *Unified Numbering System for Metals and Alloys,* 2nd ed. Warrendale, Pa., Society of Automotive Engineers, 1977, were selected for anti-corrosion evaluation:

1. Steel, mild carbon, (Unified Designation G10200). Used in tanks and vehicle fuel lines.
2. Zinc casting alloy, (Unified Designation Z35531). Used in carburetors and fuel pumps.
3. Aluminum casting alloy, (Unified Designation A03840). Used in carburetor and fuel pumps.
4. Brass, cartridge, 70%, (Unified Designation C26000). Used in dispensing systems, valves, carburetor jets, and connectors.
5. Ninety percent lead-10% tin alloy used widely on terneplate, (Unified Designation L05100). Used in vehicle fuel tanks.

The bottles and contents were then stored at 43° C. for a pre-determined time (14 days). During this time, the fuels were changed 10 times. That is, at the end of each day, excluding weekend days, the bottles were emptied of their fuel contents and a fuel sample of the particular fuel being tested was added to the bottle. At the end of the 14 day period, the coupons were removed from the bottles and their condition observed and recorded. The coupons were then cleansed of corrosion product by established, non-corroding chemical procedures (boiling 20% sodium hydroxide and zinc dust for steel; saturated ammonium acetate solution at room temperature for zinc alloy; 10% sulfuric acid solution at room temperature for brass; 70% nitric acid at room temperature for aluminum and hot concentrated ammonium acetate solution for lead-tin metal alloy). The cleaned coupon was then washed with distilled water, dried, and weighed. The weight loss was taken as a measure of corrosion. The results of these tests are set forth in the following table:

TABLE I

14-DAY CORROSION INHIBITING TESTS

| Inhibitor Composition | Weight Loss, mg. | % Reduction in Weight Loss |
|---|---|---|
| STEEL | | |
| Control Fuel (No Inhibitor) Average of 2 | 102 | |
| Control Fuel + 9 PTB Tall Oil Dimer Acid + 10 PTB Sebacic Acid | 0.6 | 99 |
| BRASS | | |
| Control Fuel (No Inhibitor) Average of 2 | 10.4 | |
| Control Fuel + 9 PTB Tall Oil Dimer Acid + 10 PTB Sebacic Acid | 8.1 | 22 |
| ZINC ALLOY | | |
| Control Fuel (No Inhibitor) Average of 2 | 90 | |
| Control Fuel + 9 PTB Tall Oil Dimer Acid + 10 PTB Sebacic Acid | 8.3 | 91 |
| ALUMINUM ALLOY | | |
| Control Fuel (No Inhibitor) Average of 2 | 55 | |
| Control Fuel + 9 PTB Tall Oil Dimer Acid + 10 PTB Sebacic Acid | 59 | (7) Represents Increased Weight Loss |
| LEAD-TIN ALLOY | | |
| Control Fuel (No Inhibitor) Average of 2 | 45 | |
| Control Fuel + 9 PTB Tall Oil Dimer Acid + 10 PTB Sebacic Acid | 11 | 76 |

The results summarized in Table I clearly demonstrate that the two component corrosion inhibitor additives of the present invention are effective corrosion inhibitors in alcohol-based fuels at very low concentrations. The results show that steel, brass, zinc alloy and lead-tin alloy exposed to fuels containing the corrosion inhibitors of the invention exhibited a significant reduction in weight loss when compared to like metals and metal alloys exposed to the same fuel blends containing no corrosion inhibitors.

I claim:

1. A liquid fuel for use in internal combustion engines comprising a major amount of a monohydroxy alkanol having from 1 to about 5 carbon atoms, and a corrosion inhibiting amount of a mixture of (a) from about 5 to 95 parts of at least one polymerized unsaturated aliphatic monocarboxylic acid having from about 16 to 18 carbon atoms per molecule, and (b) from 95 to 5 parts of an aliphatic dicarboxylic acid having from 2 to about 10 carbon atoms.

2. The fuel of claim 1 wherein said alkanol is anhydrous or substantially anhydrous ethanol.

3. The fuel of claim 1 wherein said alkanol is hydrous ethanol.

4. The fuel of claim 3 wherein said ethanol contains up to about 25 volume percent water.

5. The fuel of claim 1 wherein said mixture of components (a) and (b) is present in an amount of from about 1.0 to about 100 ppm.

6. The fuel of claim 1 wherein the polymerized unsaturated aliphatic monocarboxylic acid is polymerized tall oil fatty acid.

7. The fuel of claim 1 wherein the polymerized unsaturated aliphatic monocarboxylic acid is oleic acid.

8. The fuel of claim 1 wherein the polymerized unsaturated aliphatic monocarboxylic acid is linoleic acid.

9. The fuel of claim 1 wherein the aliphatic dicarboxylic acid is oxalic acid.

10. The fuel of claim 1 wherein the aliphatic dicarboxylic acid is sebacic acid.

11. The fuel of claim 1 wherein the aliphatic dicarboxylic acid is azelaic acid.

12. A process for conferring anti-corrosion properties to an alcohol-based fuel which comprises blending a monohydroxy alkanol having from 1 to about 5 carbon atoms with a corrosion inhibiting amount of a mixture of (a) from about 5 to 95 parts of at least one polymerized unsaturated aliphatic monocarboxylic acid having from about 16 to 18 carbon atoms per molecule, and (b) from about 95 to 5 parts of an aliphatic dicarboxylic acid having from 2 to about 10 carbon atoms.

13. The process of claim 12 wherein said alkanol is anhydrous or substantially anhydrous ethanol.

14. The process of claim 12 wherein said alkanol is hydrous ethanol.

15. The process of claim 14 wherein said ethanol contains up to about 25 volume percent water.

16. The process of claim 12 which comprises blending about 1.0 to 100 ppm of components (a) and (b) with said alkanol.

17. The process of claim 12 wherein the polymerized unsaturated aliphatic monocarboxylic acid is tall oil fatty acid.

18. The process of claim 12 wherein the polymerized unsaturated aliphatic monocarboxylic acid is oleic acid.

19. The process of claim 12 wherein the polymerized unsaturated aliphatic monocarboxylic acid is linoleic acid.

20. The process of claim 12 wherein the aliphatic dicarboxylic acid is oxalic acid.

21. The process of claim 12 wherein the aliphatic dicarboxylic acid is sebacic acid.

22. The process of claim 12 wherein the aliphatic dicarboxylic acid is azelaic acid.

23. A corrosion inhibitor concentrate for use in an alcohol-based fuel comprising from about 35% to about 85%, by weight, of a mixture of (a) from about 5 to 95 parts of at least one polymerized unsaturated aliphatic monocarboxylic acid having from about 16 to 18 carbon atoms per molecule, (b) from about 95 to 5 parts of an aliphatic dicarboxylic acid having from 2 to about 10 carbon atoms, and (c) from about 65% to about 15%, by weight, of at least one normally liquid hydrocarbon solvent.

24. A concentrate of claim 23 wherein the polymerized unsaturated aliphatic monocarboxylic acid is polymerized tall oil fatty oil.

25. A concentrate of claim 27 wherein the polymerized unsaturated aliphatic monocarboxylic acid is oleic acid.

26. A concentrate of claim 27 wherein the polymerized unsaturated aliphatic monocarboxylic acid is linoleic acid.

27. A concentrate of claim 23 wherein the aliphatic dicarboxylic acid is oxalic acid.

28. A concentrate of claim 23 wherein the aliphatic dicarboxylic acid is sebacic acid.

29. A concentrate of claim 23 wherein the aliphatic dicarboxylic acid is azelaic acid.

30. A concentrate of claim 27 wherein said hydrocarbon solvent is mineral oil.

31. A concentrate of claim 27 wherein said hydrocarbon solvent is xylene.

32. A concentrate of claim 27 wherein said hydrocarbon solvent is aromatic naptha.

* * * * *